United States Patent [19]

Schmidt

[11] 3,976,083

[45] Aug. 24, 1976

[54] BRASSIERE HAVING SIMULATED NIPPLES

[76] Inventor: Jakob E. Schmidt, 934 Monroe St., Charlestown, Ind. 47111

[22] Filed: Feb. 27, 1975

[21] Appl. No.: 553,779

[52] U.S. Cl. ..... 128/425; 128/463

[51] Int. Cl.[2] ..... A41C 3/00

[58] Field of Search ..... 128/425, 462, 463, 465, 128/479, 480, 481, 505, 510; 2/267, 67; 3/36

[56] References Cited

UNITED STATES PATENTS

| | | | |
|---|---|---|---|
| 2,082,503 | 6/1937 | Meadows | 128/481 |
| 2,108,205 | 2/1938 | Martin | 3/36 |
| 2,543,499 | 2/1951 | Kausch | 3/36 |
| 2,563,241 | 8/1951 | Herbener | 2/267 X |
| 2,669,719 | 2/1954 | Steiner | 128/463 |
| 3,285,247 | 11/1966 | Morin | 128/479 |
| 3,401,407 | 9/1968 | Pittman | 128/481 X |

FOREIGN PATENTS OR APPLICATIONS

| | | | |
|---|---|---|---|
| 787,498 | 7/1935 | France | 128/463 |

*Primary Examiner*—Werner H. Schroeder
*Assistant Examiner*—Moshe I. Cohen
*Attorney, Agent, or Firm*—Pollock, Vande Sande & Priddy

[57] ABSTRACT

A brassiere is disclosed having cups which are provided with a nipple-like protuberance simulating the bulge of a natural nipple. The nipple-like bulge or protuberance may be a built-in component of the brassiere, usually situated under the fabric of the cup; a component which is permanently attached to the external surface of the brassiere cup; or an individual structure which may be attached to or detached from the brassiere cup at will, by means of several linkage and attachment mechanisms.

8 Claims, 45 Drawing Figures

FIG. 1A PRIOR ART
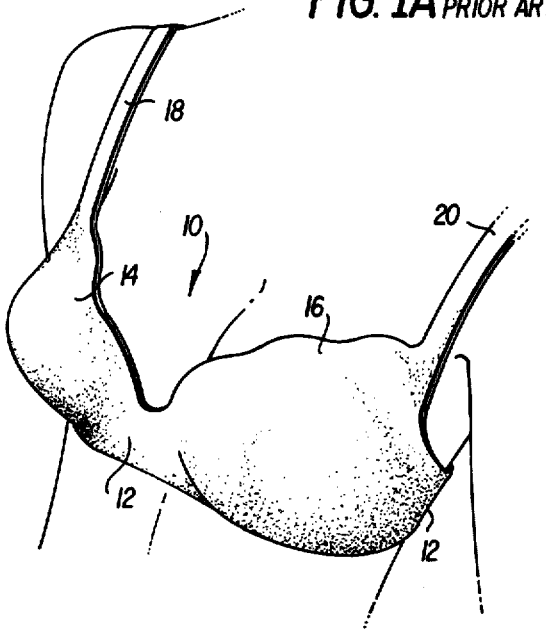
FIG. 1B PRIOR ART
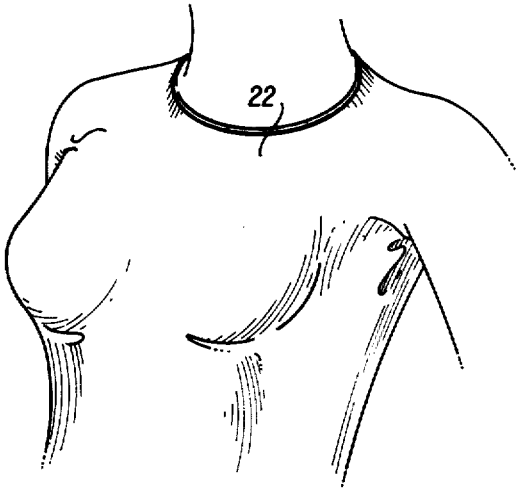
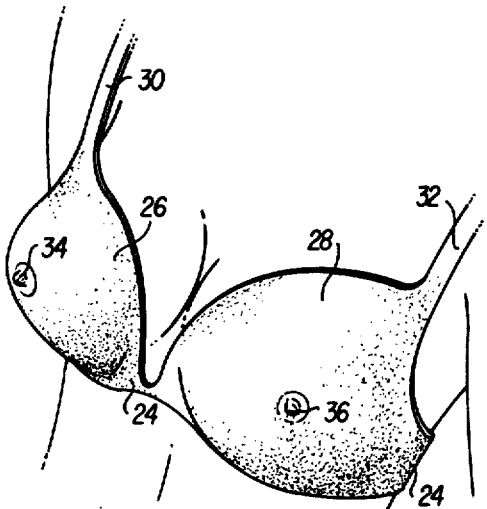
FIG. 2A
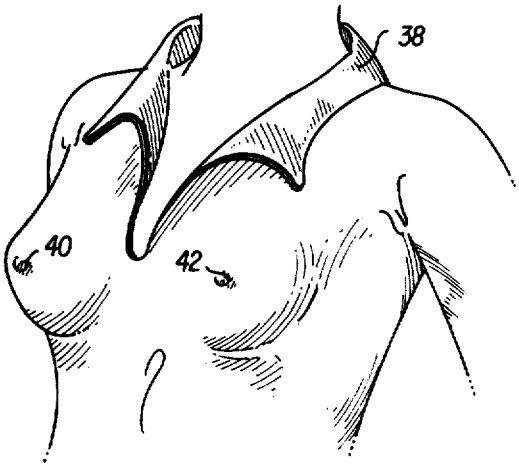
FIG. 2B FIG. 4C
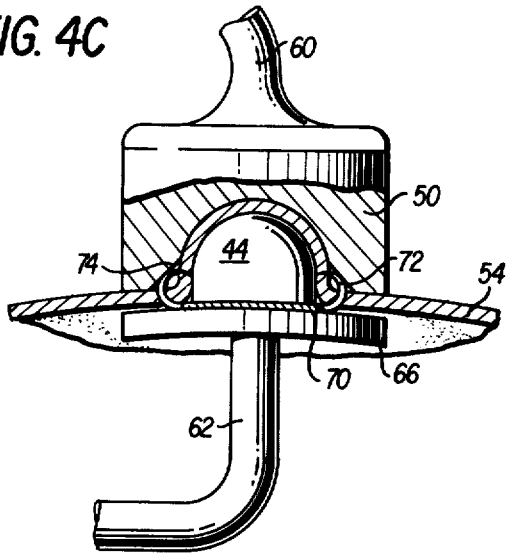
FIG. 4D
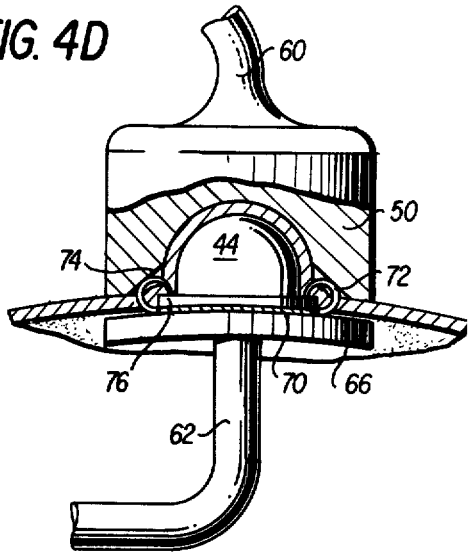
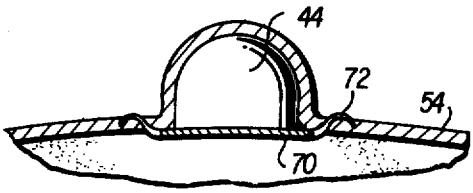
FIG. 4E
FIG. 4F
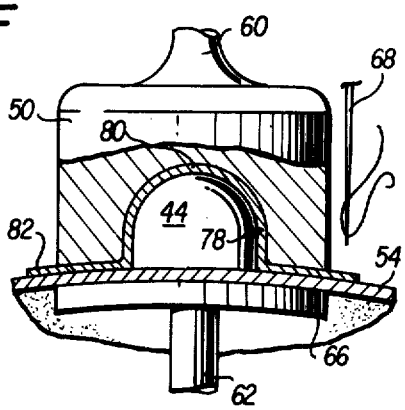
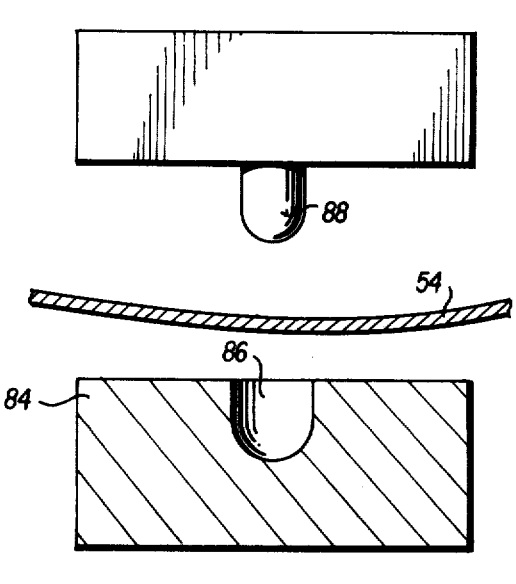
FIG. 6

FIG. 7A
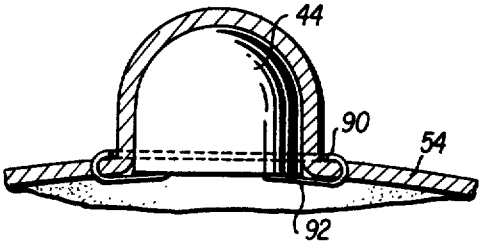
FIG. 7B
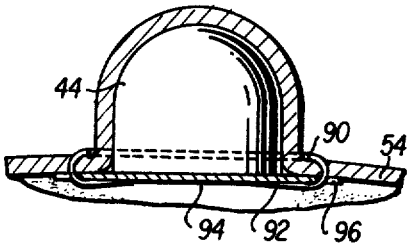
FIG. 7C
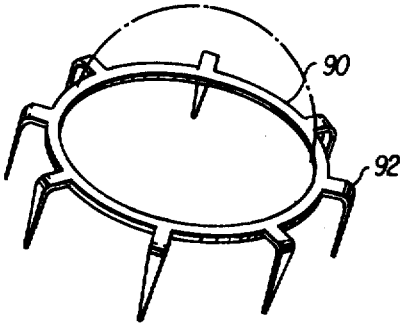
FIG. 7D
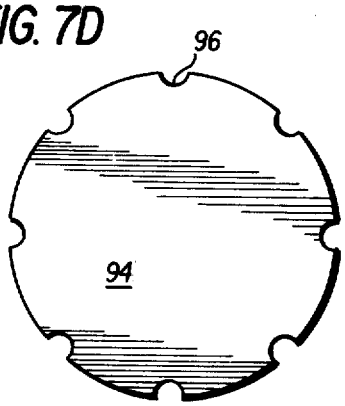
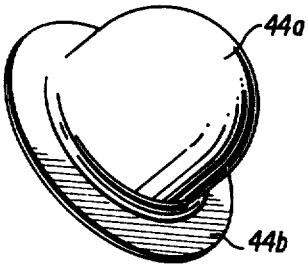
FIG. 8
FIG. 9
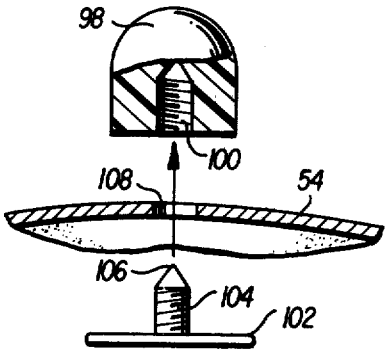

FIG. 10A
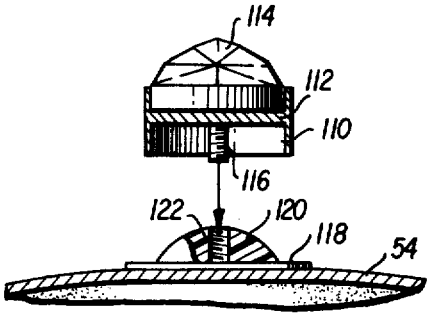
FIG. 10B
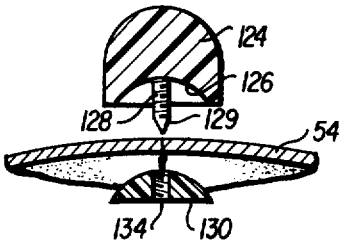
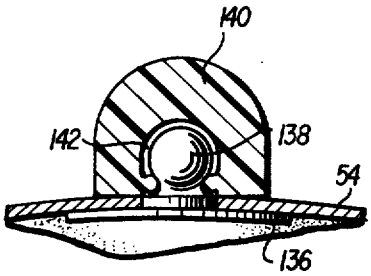
FIG. 11
FIG. 12
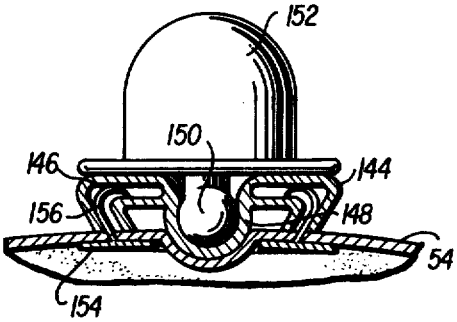
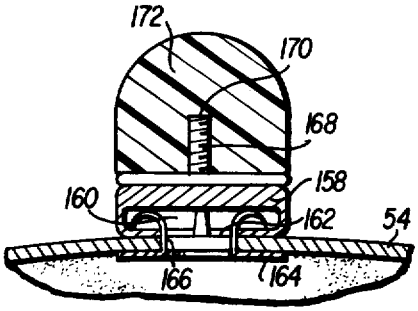
FIG. 13
FIG. 14
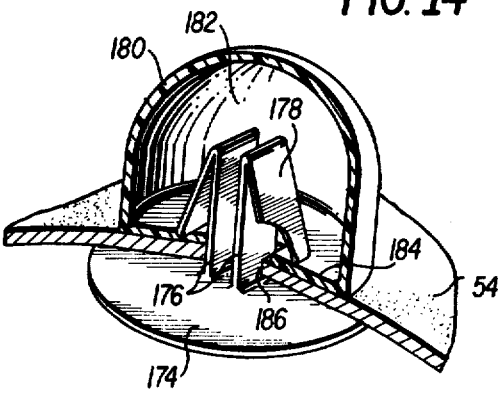

FIG. 15
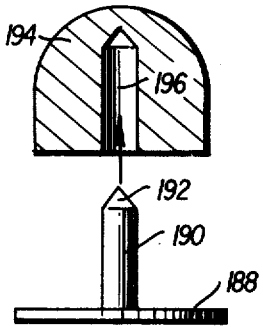
FIG. 16A
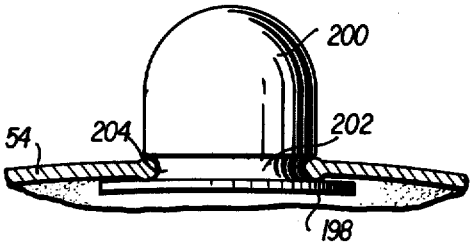
FIG. 16B
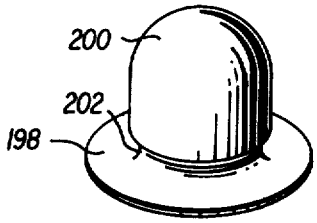
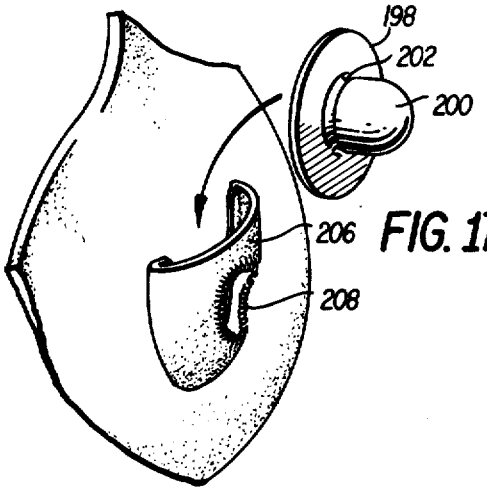
FIG. 17
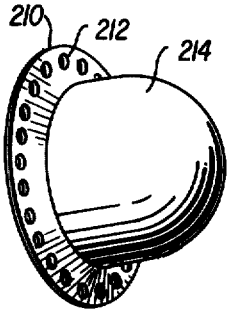
FIG. 18
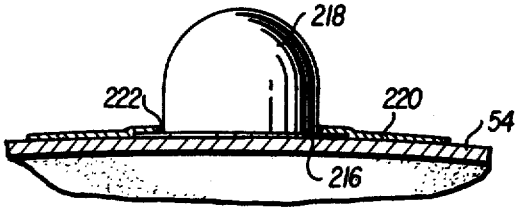
FIG. 19
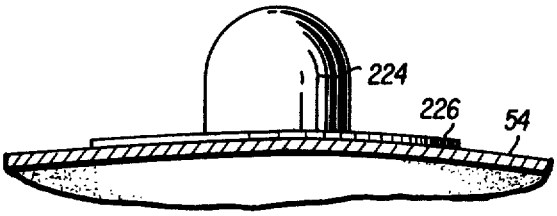
FIG. 20

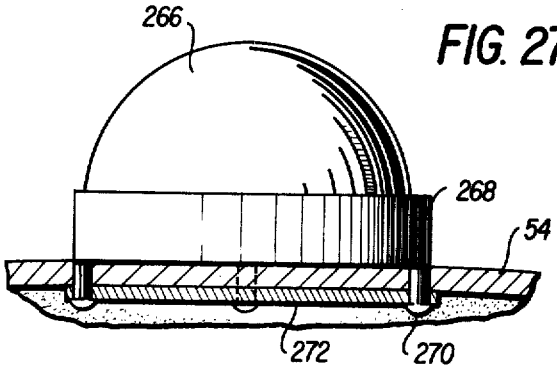
FIG. 27
FIG. 28
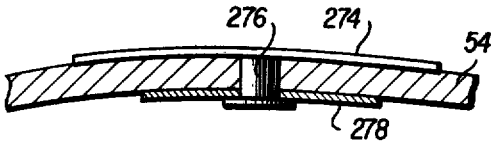
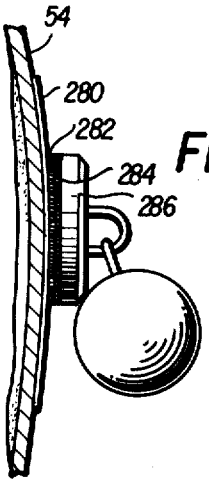
FIG. 29
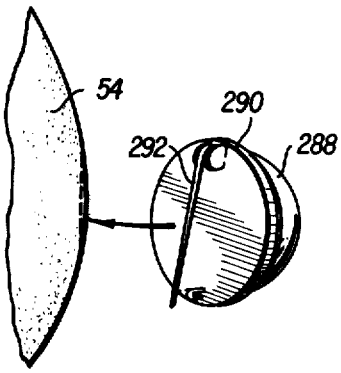
FIG. 30
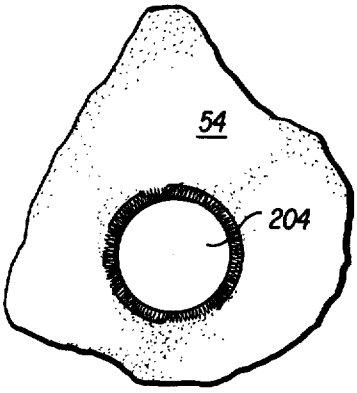
FIG. 16C FIG. 21
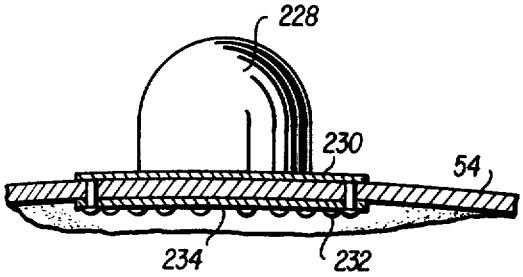
FIG. 22
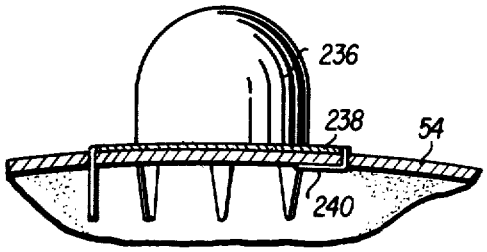
FIG. 23
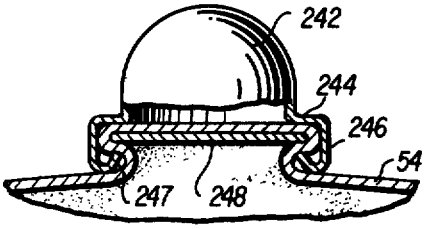
FIG. 24
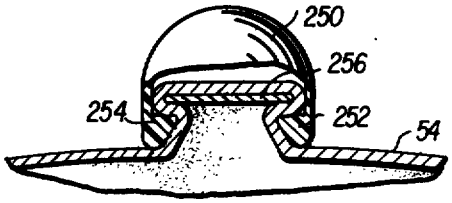
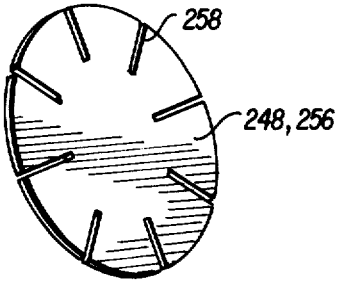
FIG. 25
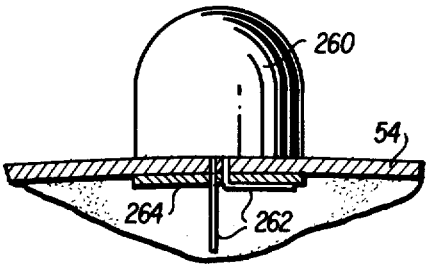
FIG. 26

BRASSIERE HAVING SIMULATED NIPPLES

BACKGROUND OF THE INVENTION

Since the development of the lady's brassiere in the late nineteenth century, brassiere designs have been promoted which lift, separate, pad and otherwise shape the human female breast; but, incongruously, until quite recently brassieres have been designed to mask or hide the location and eye appealing shape of the nipple of the breast. In more recent times, the so-called natural look or "braless" look has achieved great popularity, particularly among younger women, with the result that the absence of a nipple impression on the bodice of the wearer's garments is frequently considered undesirable as being unrealistic and unnatural.

Aesthetically, the absence of the nipple protuberance on her outer garment may be a source of anxiety or embarrassment for the lady who wishes to give the appearance of today's natural look but, due to the uncovered appearance of the particular individual's breast or other matters, is unwilling to go without a brassiere.

Thus, it is apparent that simulated nipples for a brassiere would offer an acceptable compromise for ladies who do not wish to go without a brassiere and a welcome release from the subconscious effects of the suppression brought on by wearing brassieres of the types variously available, which obliterate the nipple. The normal female nipple of a non-parous woman is too soft in its non-erected condition to produce a noticeable protrusion through the fabrics of a brassiere and an outer garment. Even in cases where the nipple does have sufficient firmness, as in parous women, it usually has too soft a foundation in the underlying substance of the breast to impress a protrusion in multiple layers of overlying fabrics. Instead of creating such a protrusion it sinks into the yielding aerolar tissue of the breast glands.

OBJECTS OF THE INVENTION

An object of the invention is to provide a brassiere having a simulated nipple which will produce in the part of the outer garment overlying the breast, an elevation that suggests the presence behind it of the normal breast nipple.

Another object of the invention is to provide a brassiere having a simulated nipple which will enable ladies not wishing to go without a brassiere to have a more desirably shaped bosom which has the outward appearance of the naked or unaided breast covered by a single outer garment.

A further object of the invention is to provide a brassiere having simulated nipples which gives the lady the benefits of the necessary lift, beautifying separation and form adjustment of the conventional brassiere while, at the same time, effecting the modern braless or natural look by providing an attractive, though simulated nipple protuberance. Also another object is to provide separate attachable-detachable nipple simulators, for the new and the old brassieres.

SUMMARY OF THE INVENTION

The illusion of the presence of a breast nipple under the blouse or sweater is created by the nipple-like elevation at the appropriate location on the brassiere. This elevation is formed by the nippled brassiere herein disclosed or by a conventional brassiere modified by the attachment of nipple simulators. The nipple simulators may have a permanent attachment to the cups of the new or old-type brassiere or they may be attached to or inserted into the cups temporarily, in a variety of ways.

In accordance with some embodiments of the invention, the desired nipple protuberance may be provided by a nipple simulator which is embedded in the materials or fabrics forming the cups of the brassiere. In this way, the nipple simulator itself is invisible, being covered by the fabric of the brassiere cup. Only the resulting nipple bulge is obvious on the surface of the brassiere. In brassieres having a padding or a lining, no part of the simulated nipple can be seen even from the inside of the cup. But in brassieres having no cup lining, a small part of the attachment mechanism may be visible on the interior surface of the cup.

The simulated nipples according to this invention may be made in many sizes and shapes and from a great variety of materials. There is also a wide selection of mechanisms for attaching the simulated nipples to the conventional brassiere. Since the natural nipple of the female breast occurs in a surprising variety of sizes, ranging from that of a small pea to that of a sewing thimble, the simulated nipples according to the invention are provided in a great variety of sizes, to balance the symmetry of a given brassiere and to suit the desires of a particular wearer. Thus, there may be variety of choices from the petite size which provides a mere hint of a protuberance to larger sizes which provide a significantly more noticeable protuberance.

Although the natural breast nipple is considered by many to be attractive when viewed with the background of the female breast, it loses something in appeal when viewed as a structure of its own, apart from the breast. For this reason, the invention does not necessarily strive to make the simulated nipple look like the real thing. While some of the embodiments of the invention do have the appearance of the anatomical nipple, many of the embodiments may include structure having beauty in its own right. In any event, the structure of the simulated nipples according to the invention is chosen to suggest the appearance of the normal nipple under the sweater, blouse or other outer garment of the wearer. Obviously, a great variety of materials may be used in the manufacture of the simulated nipples including plastics, rubber, wood, glass, porcelain, mother-of-pearl, cloth, ivory, stainless steel, brass, copper, pewter, silver, yellow and white gold, platinum, semi-precious and precious stones, and the like.

The basic form of the simulated nipple according to the invention is comprised essentially of two parts, a stud and a base. The stud is a short, cylindrical structure, representing the nipple of a natural breast and having an exterior profile similar thereto. The base or support upon which the stud sits and to which it is sometimes rigidly attached, is an essentially circular plate corresponding approximately in size to the natural aerola, the pigmented circle surrounding the natural nipple. The stud provides the mass or bulk on the external surface of the cup of the brassiere according to the invention, which creates the bulge in the outer garment of the lady and the illusion of a natural nipple behind the bulge.

In some embodiments of the invention, the stud is covered by the fabric of the cup. In other embodiments particularly the attachable and detachable simulated nipples according to the invention, the studs are not only functional but also ornamental since they are visible on the exterior surface of the brassiere cups. For convenience of description and reference, the end of the stud which is farthest from the base, or the end of the nipple which is farthest from the breast, is defined as the distal end. The other end of the stud, which is nearer to the base, brassiere cup or breast, is defined as the proximal end.

In its simpler form, the base may be a circular plate of optional thickness measuring perhaps one to two centimeters in diameter. In some forms of the nipple simulator, the base and the stud are an integral structure; however, in most forms, the base and the stud are separate structures. When the stud and base are separate structures, the invention provides means for connecting one to the other and for connecting the combination to the brassiere cup. In some instances, the base is attached temporarily or permanently to the cup of the brassiere while the stud is the part that is attached and detached. In other forms, there is no permanent or temporary attachment to the cup. In these forms, the stud and its base are placed on opposite sides of the cup, and, when the two are linked, the outer layer of the cup fabric becomes trapped therebetween to provide a support for the simulated nipple.

As previously mentioned, in one embodiment of the invention, the nipple simulator is built into the fabric structure of the brassiere cup and is not removable. Such an embodiment is preferred by many ladies because it is complete in itself and requires no special care during laundering and so forth. Only the nipple protuberance according to this invention differentiates this modern, natural appearing brassiere from the conventional type known in the prior art.

As mentioned, other brassieres according to the invention may include detachable simulated nipples. These detachable or separable simulated nipples can be worn with conventional brassieres of which the wearer may have a greater supply. Usually, the investment in detachable simulated nipples for available brassieres will be substantially less than in all new brassieres having built-in nipples.

Since the detachable or separable simulated nipples according to the invention are relatively easily attached and detached, the wearer has a choice with regard to the point of attachment to the cup. A breast whose natural nipple is situated at or near its center when viewed from the front is considered by many to have the most desirable appearance. Unfortunately, this appearance is usually only found in younger ladies and girls whose breasts have a considerable degree of firmness. Differences in body weight, the passage of years and related effects may cause the natural breast to sag or be displaced downward with the result that the natural nipple is displaced from its most desirable location.

The detachable or separable simulated nipples according to the invention enable a lady, regardless of her age or particular physical condition, to place the nipple on her brassiere in the location which is preferable to her. Various factors may influence a person's choice of nipple prominence and location such as the season of the year, the type of outer garment, the texture of the outer garment material, the mood of the individual, the company which she may be keeping, the type of occasion and related factors. Obviously, the simulated nipples according to the invention provide a sufficient variety to accommodate the varying conditions or moods under which the wearer may wish to use them.

Further, the detachability feature of some embodiments of the invention also gives the lady the option of not wearing the simulators at all at a given time or for a particular occasion. The option really is open to the wearer whether she uses the detachable nipple simulators with an older, conventional brassiere or with a brassiere according to the invention having a permanently attached mounting base. In the latter instance, the base itself would add little or no bulk to the cup; thus, without the stud, the presence of the base would not be noticed through the lady's outer garments.

BRIEF DESCRIPTION OF THE DRAWINGS

FIG. 1A shows the torso of a lady wearing a conventional prior art brassiere.

FIG. 1B shows the torso of a lady wearing a prior art brassiere beneath an outer garment such as a sweater, indicating the unnatural appearance of the lady's breasts when the prior art brassiere is worn.

FIG. 2A shows the torso of a lady wearing a brassiere having simulated nipples according to this invention.

FIG. 2B shows the torso of a lady wearing a brassiere having simulated nipples according to the invention beneath an outer garment such as a blouse or sweater, indicating the more natural appearance of the lady's breasts when wearing the brassiere according to the invention.

FIG. 4C illustrates a second mode of attachment of simulated nipples according to the invention.

FIG. 4D illustrates a third mode of attachment of simulated nipples according to the invention.

FIG. 4E illustrates a fourth mode of attachment of simulated nipples according to the invention.

FIG. 4F illustrates a fifth mode of attachment of simulated nipples according to the invention.

FIG. 6 illustrates schematically another type of apparatus used for manufacturing brassieres having built-in nipple simulators according to the invention.

FIG. 7A and 7B illustrate further modes of attachment of simulated nipples according to the invention; and FIGS. 7C and 7D illustrate component parts of the attachment devices illustrated in FIGS. 7A and 7B.

FIG. 8 shows a perspective view of a basic type of simulated nipple according to the invention.

FIG. 9 illustrates the structure and mode of attachment of a detachable, screw-on simulated nipple according to the invention.

FIGS. 10A and 10B illustrate alternative forms of detachable, screw-on simulated nipples according to the invention.

FIGS. 11 and 12 illustrate alternate forms of detachable, snap-on simulated nipples according to the invention.

FIG. 13 illustrates a further type of screw-on simulated nipple according to the invention.

FIG. 14 illustrates a type of simulated nipple having a locking prong attachment. FIG. 15 illustrates another type of simulated nipple attachment according to the invention.

FIGS. 16A, B and C illustrate the grooved simulated nipple according to the invention and its mode of attachment.

FIG. 17 shows a perspective view of a simulated nipple and its retaining pocket according to the invention.

FIG. 18 illustrates a type of simulated nipple peculiarily adapted for attachment by sewing.

FIG. 19 illustrates a permanently attached simulated nipple which is joined to the outer layer of material of the brassiere cup using an iron-on or similar adhesive.

FIG. 20 illustrates another type of simulated nipple attached using an iron-on or similar adhesive.

FIG. 21 illustrates a mode of simulated nipple attachment involving the use of deformable rivets.

FIG. 22 illustrates a simulated nipple having a base element with depending deformable teeth which grip the outer layer of material of the brassiere cup.

FIG. 23 illustrates a simulated nipple having a plurality of flexible fingers depending therefrom which grip an anchor plate located on the opposite side of the outer layer of the brassiere cup from the base itself.

FIG. 24 illustrates a simulated nipple having a flexible depending flange which grips an anchor plate located on the opposite side of the outer layer of the brassiere cup from the simulated nipple.

FIG. 25 illustrates an anchor plate suitable for use in the embodiments of FIGS. 23 and 24.

FIG. 26 illustrates a simulated nipple having deformable tabs which are inserted through the outer layer of material of the brassiere cup.

FIG. 27 illustrates a variation of the simulated nipple shown in FIG. 21.

FIG. 28 illustrates a permanently installed base according to the invention, to which various stud elements may be attached.

FIG. 29 illustrates a detachable simulated nipple according to the invention which comprises a VELCRO fastener.

FIG. 30 shows a detachable simulated nipple having a pin fastener.

DETAILED DESCRIPTION OF THE PREFERRED EMBODIMENTS

Figure 3A:
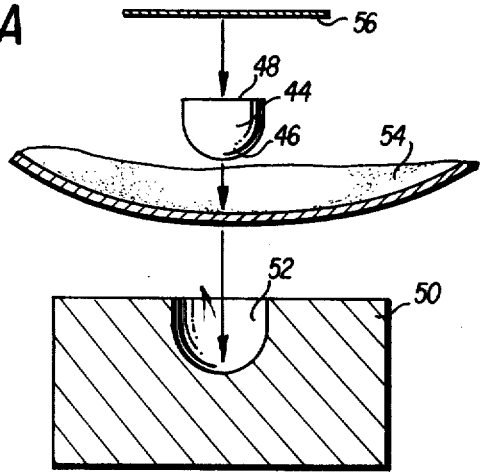
FIG. 3A illustrates schematically the apparatus used to manufacture a brassiere having a built-in nipple simulator according to the invention.

There follows a detailed description of the preferred embodiments according to the invention, reference being had to the drawings in which like reference numerals identify like elements of structure in each of the several Figures.

FIG. 1A shows the upper torso of a human female in which the lady's breasts are covered and supported by a prior art brassiere 10 which lifts and shapes the breast in a manner well known to those in the art. Brassiere 10 comprises a brassiere band 12 encircling the wearer's chest at a location below the breasts and a pair of breast receiving cups 14 and 16 disposed along the length thereof in position to support the lady's breasts. A pair of shoulder support straps 18 and 20 provide additional support for breast receiving cups 14 and 16, as indicated. It should be noted that the conventional prior art brassiere effectively obliterates or masks the appearance of the normal nipple of the breast which would be visible without the brassiere. FIG. 1B illustrates the same torso as shown in FIG. 1A wherein an outer garment such as a sweater, tee shirt, or the like has been donned by the wearer. Again, it is to be noted that while the conventional brassiere 10 provides an appealing shaping and lifting of the wearer's breasts, the net effect when the conventional brassiere is worn under an outer garment such as sweater 22 is decidedly unnatural in appearance since the nipples of the lady's breasts are entirely obscured.

FIG. 2A illustrates the same female torso in which the lady's breasts are supported by a brassiere having simulated nipples according to the invention. The brassiere according to the invention comprises a brassiere band 24 having a pair of breast receiving cups 26 and 28 serially disposed thereon, the breast receiving cups additionally being supported by a pair of shoulder straps 30 and 32 in the usual manner. The distinguishing feature of the brassiere according to the invention is the provision of clearly noticeable protruding simulated nipples 34 and 36 which are located on the breast receiving cups of the brassiere in a position selected to give the appearance of a desirable breast form. FIG. 2B shows the torso of the wearer illustrated in FIG. 2A including an outer garment such as a shirt or sweater 38. In this instance, compared to the unnatural appearance of the lady's breasts in FIG. 1B, the brassiere according to the invention provides protuberances 40 and 42 visible through the material of the shirt or sweater 38. The presence of these protuberances provides the illusion that the wearer is braless beneath the outer garment, thus enabling the wearer to enjoy the additional comfort and support provided by the brassiere while producing the exterior appearance of the more natural or braless look popular in these times. As previously mentioned, the size and location of protuberances 40 and 42 may be chosen or adjusted by the wearer to suit her particular need or fancy at a particular time.

FIG. 3A illustrates schematically the apparatus used to produce a brassiere having a built-in nipple according to the invention. A stud 44 is provided which resembles in size and shape, the natural nipple of the female breast. The stud is used to create the built-in bulge in the breast receiving cup of the brassiere. It is generally made of plastic or similar material, although it may be formed from a variety of other materials as previously discussed. Stud 44 has an essentially cylindrical body having at its distal end a generally domed or rounded configuration 46. The proximal end 48 of the stud is flat or slightly concave.

Figure 3B:
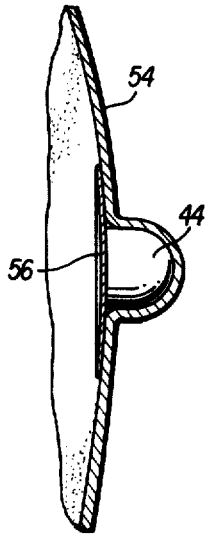
FIG. 3B illustrates a crosssection through the brassiere cup of a brassiere having a built-in nipple simulator according to the invention.

A female die 50 is provided which includes a hole or depression 52 identical in shape with that of stud 44 but somewhat larger. The outer layer 54 of the breast receiving cup of the brassiere is placed over depression 52 in the position chosen for placement of the simulated nipple. The distal end 46 of stud 44 is then placed on the inner surface of the breast receiving cup at the location where it rests above the depression 52 of female die 50. Stud 44 is then forced into depression 52, drawing a portion of the fabric layer 54 with it. Fabric layer 54 may be previously treated with fabric setting compounds such as are well known in the art, which will cause the fabric to retain its deformed shape after it is removed from depression 52. Alternatively, fabric layer 54 may be formed of a thermoplastic material and female die 50 may be heated somewhat, whereby the fabric layer 54 will be formed as stud 44 is depressed into depression 52 and will retain its shape when removed from depression 52. After the fabric compressed between stud 44 and depression 52 has set, the pressure acting upon stud 44 may be released and stud 44 will remain in the die. A piece of iron-on fabric 56, for example, may then be fused to the interior surface of fabric layer 54 to secure stud 44 in its chosen location. The completed built-in simulated nipple may then be removed from depression 52 and will retain its shape as indicated in FIG. 3B. Note that FIG. 3B shows only the outer layer of fabric 54, it being understood that inner layers of material or padding may be provided without departing from the spirit of the invention. Of course, in some instances, it may be desirable to attach the nipple to an interior layer to provide a less noticeable bulge.

Figure 4A:
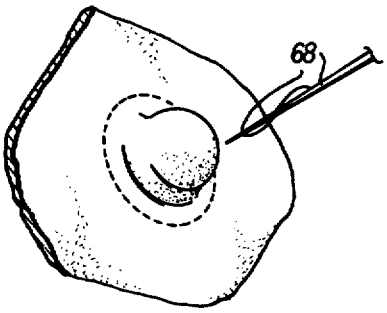
FIG. 4A is a perspective view of the exterior of a brassiere cup having a simulated nipple according to the invention, indicating one mode of attaching the simulated nipple to the outer fabric layer of the brassiere cup.

The durability of the attachment of iron-on fabric 56 may be enhanced by providing one or more circular and concentric rows of stitches close to and around the nipple-like projection on the cup, as indicated in FIG. 4A. Alternatively, where stitching is to be employed, fabric 56 need not be of the iron-on variety but may be a plain conventional fabric.

Figure 4B:
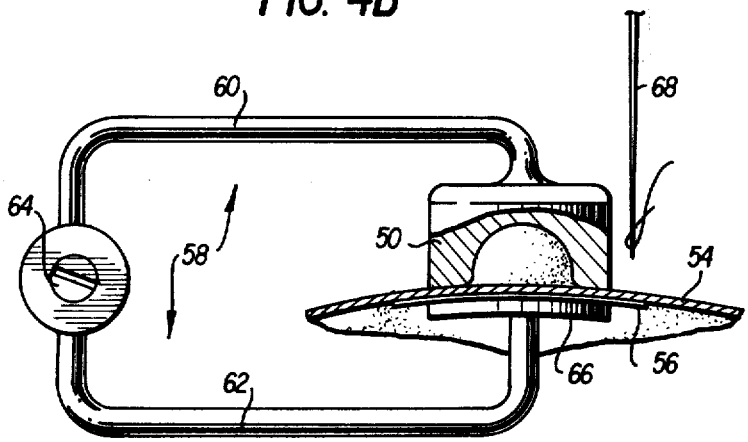
FIG. 4B illustrates one type of apparatus which may be used for attaching the simulated nipples according to the invention to a brassiere cup.

FIG. 4B illustrates a clamping mechanism which may be used to simplify the attachment of the simulated nipple shown in FIGS. 3B and 4A. Clamping mechanism 58 includes a pair of arms 60 and 62 pivoted at 64 to provide a miniature die press. Female die 50 is attached to arm 60 and a platen 66 is attached to arm 62. Platen 66 forces stud 44 into depression 52 and also may be used to hold fabric 56 in position while additional threaded attachment means are provided through the use of needle 68.

Variations on the method and structure illustrated in FIGS. 3A and 3B and 4A and 4B include the use of a fabric cement for the attachment of fabric 56, instead of a plain fabric or an iron-on fabric as previously discussed. Also, fabric 56 may be replaced by a plate of metal or plastic which, in turn, may be bonded to the fabric of the inner surface of the breast receiving cup by a suitable adhesive or other means as will be appreciated by those in the art.

FIG. 4C illustrates a further embodiment of the simulated nipples according to the invention and a means for attaching it to the breast receiving cup. A circular plate 70 is provided which includes a plurality of upwardly extending, deformable metal teeth 72, as indicated. In this instance, female die 50 is provided with cut-away portions 74 into which teeth 72 extend as clamp 58 is closed to attach the simulated nipple. Plate 70 and stud 44 are placed upon platen 66 and the outer layer 54 of the breast receiving cup placed thereover. As female die 50 is clamped over stud 44, teeth 72 will pierce fabric layer 54 and be bent by cut-aways 74 into locking contact with the sides of stud 44. After the dies are removed, the exterior of the cup will show the nipple bulge and small portions of teeth 72 extending through outer layer 54 there around.

FIG. 4D discloses a variation on the structure of FIG. 4C in which stud 44 is provided with a radially extending flange 76 which is engaged by teeth 72. FIG. 4E shows a further modification of the embodiments illustrated in FIGS. 4C and 4D wherein teeth 72 are caused to grip outer fabric layer 54 rather than the stud itself.

FIG. 4F shows a further embodiment of the nippled brassiere according to the invention in which the stud 44 is attached to the exterior of outer fabric layer 54 of the breast receiving cups. In this embodiment, a stud cover 78 is provided which has a domed portion 80 and a radially extending flange 82 surrounding the base of the domed portion. Stud cover 78 may be formed of material identical to that of outer layer 54 of the brassiere cup and may be tinted as desired to resemble the natural pigmentation of the anatomical nipple and areola. Stud cover 78 may be formed separately by means of the process illustrated with respect to FIG. 3A. The domed portion 80 of stud cover 78 is so shaped in size as to cover the stud 44 snugly. The radially extending flange 82 provides a surface by means of which the stud cover 78 may be attached to outer fabric layer 54 by means such as stitches. As illustrated in FIG. 4F, the stud is inserted within dome portion 80 of stud cover 78 and held in position on fabric layer 54 by platen 66 and female die 50, in a manner previously described. While so held, the peripheral portions of radially extending flange 82 may be sewn to fabric layer 54 using needle 68, as indicated. Alternatively, flange 82 may be glued to layer 54. This method is particularly suited for use on brassieres where fabric layer 54 is stiff or unyielding so as to prevent use of the nipple shown in FIG. 3B.

Figure 5A:
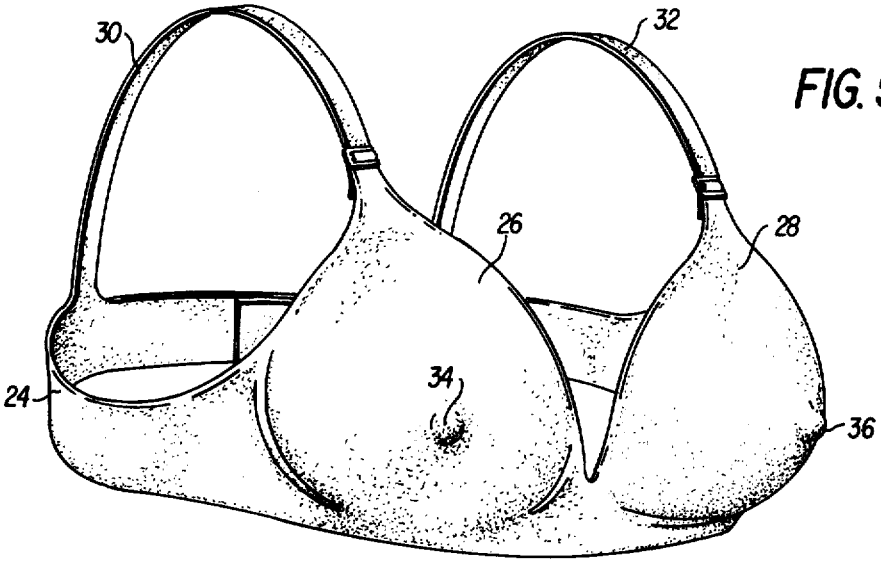
FIGS. 5A and 5B show front and rear perspective views of a brassiere according to the invention having simulated nipples built into the fabric structure of the brassiere.
Figure 5B:
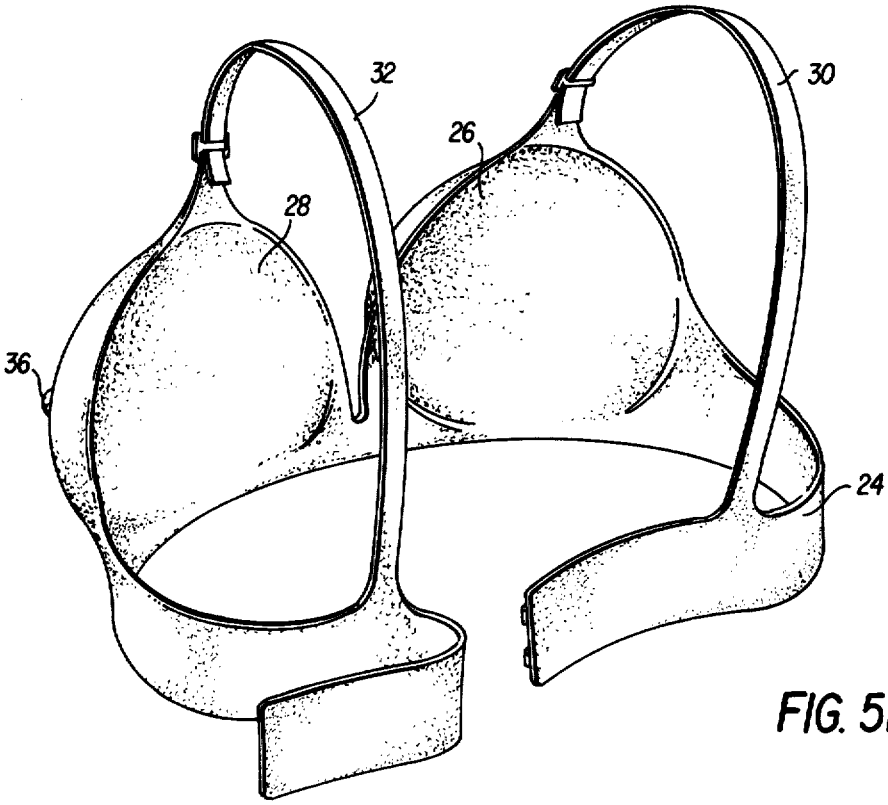

FIGS. 5A and 5B show front and rear perspective views of a brassiere having a built-in nipple according to the invention, such as illustrated in FIG. 3B. It may be observed that nipple protuberances 34 and 36 are integrated within the fabric structure of breast receiving cups 26 and 28 and that no part of the simulated nipple is visible from within or without the cups since it is covered on all sides by the layers of cup material. Thus, protuberances 34 and 36 do not depend for their prominence on the underlying support of the wearer's breasts but function separately and independently of the shape or condition of the wearer's bosom. The nippled brassiere may even be worn with the well-known breast pads where the wearer desires and still provide the desired effect; however, no pad structure is required to support the simulated nipples according to the invention.

FIG. 6 illustrates schematically an alternate form of apparatus for forming simulated nipples according to the invention. The outer layer of material 54 of the breast receiving cups is placed above female die 84 which has a depression 86 corresponding to depression 52 discussed with respect to FIG. 3A. A male die 88 is provided having a protuberance of the shape and size of the stud to be used. Male die 88 is used to press fabric layer 54 into depression 86 to form a nipple-like shell. After the nipple-like shell within the female die has set, with the aid of a fabric hardener for example, the male die 88 is withdrawn and a stud is glued into the fabric-lined cavity. Heat or any other agent appropriate for the type of adhesive used is then applied to complete the bonding process. When the bonding action has been completed, the female die is removed and the nipple-like projection on the external surface of the breast receiving cup is thus made a permanent part of the brassiere.

FIG. 7A illustrates one type of built-in nipple which may be manufactured using the apparatus shown in FIG. 6. After the fabric layer 54 of the breast receiving cup has been formed and set in the shape of the nipple protuberance, the female die 84 is removed leaving a nipple-like structure on the cup. A narrow metal ring 90, illustrated in FIG. 7C, with an inside diameter equal to the outside diameter of the nipple stud and its fabric covering is pressed over the covered stud. The metal ring includes a plurality of small teeth 92 which pierce fabric layer 54 and are then bent inwardly to retain stud 44 in position. If desired, an anchor plate 94 may be placed in contact with the proximal end of stud 44 and teeth 92 bent into contact with anchor plate 94 as shown in FIG. 7B. This provides a somewhat superior attachment compared to that shown in FIG. 7A. To provide a more secure joint between teeth 92 and anchor plate 94, anchor plate 94 may be provided with a plurality of peripheral indentations 96, as indicated in FIG. 7D, which receive teeth 92 as the teeth are bent into contact with the anchor plate. If desired, teeth 92 may be replaced by downwardly projecting rivet elements which coact with holes or indentations located in the anchor plate. See FIG. 21. In all instances, a circular patch of soft cloth may be bonded to the interior of layer 54 to prevent skin irritation due to teeth 92 or, if the brassiere cups are lined, to minimize snagging on the liner.

FIG. 8 illustrates a basic form of the simulated nipple according to the invention which consist essentially of two basic parts, a stud 44A and a base 44B. As previously mentioned, the stud provides the mass or bulk on the external surface of the brassiere cup and the base may be adapted to provide an attachment for the simulated nipple to the brassiere.

FIG. 9 illustrates a variety of detachable simulated nipple. A stud 98 includes a threaded bore 100 centrally located in its poximal end. A base 102 is provided with an upstanding threaded stem 104 having a pointed tip 106. Tip 106 may be forced through outer fabric layer 54 of the breast receiving cup to permit threaded bore 100 of stud 98 to be threadingly attached thereto. If desired, an opening 108 may be provided in outer fabric layer 54 to facilitate insertion of stem 104; however, layer 54 may also be pierced preliminarily by a punch or nail to facilitate nipple installation. Although it is preferred to locate the threaded stem in the base portion of the simulated nipple, it is also possible to attach it to the stud portion as indicated in FIGS. 10A and 10B.

In FIG. 10A, an essentially cylindrical bezel 110 is provided which has a central support surface 112 therein. A decorative button or gem-like stud 114 is mounted on the upper surface of support 112 and a threaded stem 116 is attached to the lower surface thereof. Base 118 may be suitably attached to the outer surface of fabric layer 54 by sewing, fabric cement or a similar device. Attached to the upper surface of base 118 is attachment boss 120 which includes a threaded bore 122 located centrally thereof. As is apparent from FIG. 10A, stud 114 is attached to the brassiere by screwing stem 116 into bore 122.

FIG. 10B shows a variation of the simulated nipple illustrated in FIG. 9 in which stud 124 includes a concave depression 126 in its proximal end from the bottom of which extends a threaded stem 128 having a pointed tip 129. Base 130 having a convex upper surface includes a central threaded bore 134 sized to receive threaded stem 128. As in the case of the device shown in FIG. 9, pointed tip 129 may be forced through outer fabric layer 54 to permit threaded stem 128 to threadingly engage bore 134.

The simulated nipples according to the invention may also be attached to the brassiere cup using snap arrangements such as those illustrated in FIGS. 11 and 12. The snap mechanisms consist of a male and a female part which snap together in a manner familiar to those in the mechanical arts. In FIG. 11, base 136 includes an upwardly extending male snap element 138 which may be pressed through outer fabric layer 54 of the brassiere cup. Stud 140 includes a corresponding female snap element 142 which resiliently engages male snap element 142 in the familiar manner to provide a detachable connection for the simulated nipple. Obviously, the male snap element could as well be incorporated on the proximal end of stud 140 and the female snap elements incorporated on the upper surface of base 136 without departing from the spirit of this invention. Also, if desired, base element 136 may be permanently attached to the cup material.

One means of permanently attaching the base portion of a snap attachment is illustrated in FIG. 12. The base 144 includes a plurality of interior passages 146 which extend upwardly therein from its lower surface. On the upper surface of base 144 may be located a female snap or gripper element 148 which is adapted to receive a male snap or gripper element 150 attached to the proximal end of stud 152. Base 144 is held on the outer surface of fabric layer 54 by a toothed ring 154 located on the opposite side of fabric layer 54 from base 144. A plurality of upwardly extending teeth 156 are provided on ring 154 which pierce outer fabric layer 154 and enter upwardly extending channels 146 of base 144. As base 144 and toothed ring 154 are compressed together, teeth 156 are deformed in the manner indicated to securely fasten base 144 to fabric layer 54.

The mode of attaching a simulated nipple illustrated in FIG. 12 may also be adapted for use with screw-on simulated nipples as indicated in FIG. 13. Here, a base 158 is provided with an interior volume 160 and a plurality of apertures 162 located in its lower surface. A toothed ring 164 having upwardly extending teeth 166 is pressed against the inner surface of outer fabric layer 54 so that teeth 166 enter interior volume 160 and are deformed into contact with base 158 as indicated. On the upper surface of base 158, an upwardly extending threaded stem 168 is provided which is threadingly received in a bore 170 of stud 172.

Yet another means of attaching the simulated nipples accodingly to the invention is illustrated in FIG. 14. Base element 174 includes a pair of centrally located, upwardly extending prongs 176 which include laterally extending, flaring blades 178. Stud 180 includes an interior volume 182 bounded by a wall 184 at its proximal end, the wall including an engagement slit 186 through which prongs 176 may be inserted. To attach the device, prongs 176 are forced through outer fabric layer 54, thereby compressing flaring blades 178 against prongs 176 until the prongs have passed through outer material layer 54. Prongs 176 are then forced through engagement slit 186 so that flaring blades 178 expand within interior volume 182 so retain stud 180 in engagement with the exterior surface of outer material layer 54.

FIG. 15 illustrates a further embodiment of the simulated nipples according to the invention in which a base 188 is provided with an upwardly extending stem 190 having a pointed tip 192 thereon. Stud 194 includes an upwardly extending interior bore 196 extending from its proximal end and sized to snugly receive stem 190. In use, base 188 may be attached to the outer surface of the breast receiving cups or stem 190 may be forced through the outer material layer 54 in a manner similar to that illustrated in FIG. 9.

FIGS. 16A, 16B and 16C illustrate a further embodiment of the invention in which the simulated nipple comprise a base element 198 and an upwardly extending stud element 200. A circumferential groove 202 surrounds stud element 200 at a location immediately adjacent the radially extending flange of base 198. In use, outer fabric layer 54 of the brassiere cups is provided with an elastic eyelet 204 having an interior diameter slightly smaller than the diameter of circumferential groove 202. Stud 200 is forced through eyelet 204 until the eyelet snaps into position in circumferential groove 202 to retain the simulated nipple within the eyelet. Alternatively, eyelet 204 may be made from a non-resilient material and stud 200 may be made from a resilient material such as rubber whereby the stud may be compressed sufficiently to pass through the eyelet which will then snugly engage the circumferential groove 202.

FIG. 17 shows a further embodiment of the invention wherein a small pocket blank 206 of suitable material is attached to the apex of the breast receiving cups of the brassiere. Pocket blank 206 includes a central opening in its outer surface which is somewhat smaller in diameter than the circumferential groove 202 of the simulated nipple shown in FIG. 16B. The simulated nipple may be placed within pocket 206 and stud 200 forced through opening 208 until the edges of the opening engage circumferential groove 202 to retain the simulated nipple within its pocket. Of course, opening 208 may be elasticized as discussed with regard to FIG. 16A, if desired.

A further variation of the simulated nipple according to the invention is illustrated in FIG. 18 which comprises a radially extending base 210 having a plurality of apertures 212 located therein and an integral stud 214 centrally located thereon. The base may be made of metal, fabric, plastic and similar materials and is stitched to the outer surface of the brassiere cup near its apex by means of needle and thread or similar devices such as fabric cement or other types of adhesive.

In the embodiment shown in FIG. 19, a radially extending base 216 supports an upwardly extending stud 218 on the exterior surface of outer material layer 54. The simulated nipple is retained in position by an annular piece of iron-on fabric 220 havng a central opening sized to fit snugly around stud 218. Annular piece 220 is fitted over stud 218 and bonded to outer material layer 54 to provide a permanent attachment. In FIG. 20, stud 224 is affixed directly to a flexible base 226 of iron-on fabric or similar material which is, in turn, bonded directly to outer material layer 54 of the brassiere cup.

In FIG. 21, the stud 228 is affixed to a base 230 having a plurality of downwardly depending rivet elements 232 which extend through fabric layer 54 and engage an anchor plate 234 to provide a permanent attachment. Similarly, the embodiment shown in FIG. 22 comprises a stud 236 rigidly attached to a base 238 which includes a plurality of downwardly depending, deformable teeth 240 which pierce outer fabric layer 54 and are bent under base 238 to provide a permanent attachment. As previously mentioned, a protective layer of cloth may be attached to the interior of the cup to minimize skin irritation or material snagging.

FIG. 23 and 24 illustrate further means of attaching the simulated nipples according to the invention. In FIG. 23, stud 242 is attached to base 244 which includes a stud of depending resilient gripping fingers 246 located around its periphery. Gripping fingers 246 include inwardly extending bite portions 247 which coact with an anchor plate 248 to secure the simulated nipple to the brassiere cup material. To assemble the device, base 244 is placed on the exterior of the outer material layer 54 and anchor plate 248 is pressed between depending resilient fingers 246 so that bite portions 247 are displaced radially, thereby permitting anchor plate 248 to snap into the illustrated location. FIG. 24 discloses a simulated nipple similar in function to that of FIG. 23 wherein stud 250 includes a flexible depending circumferential flange 252 having inwardly directed bite portions 254. Bite portions 254 coact in a manner similar to that just described with an anchor plate 256. To facilitate insertion of anchor plates 248 and 256 as shown in FIGS. 23 and 24, the anchor plates may be provided with a plurality of radially inwardly extending slots 258 as shown in FIG. 25. Thus, as anchor plates 248 and 256 are pressed into place in the manner previously discussed, the portions thereof located between slots 258 are permitted to flex somewhat thereby easing insertion of the anchor plates.

FIG. 26 shows yet another embodiment of the simulated nipples according to the invention wherein stud 260 includes a pair of downwardly extending, deformable blades 262 which may be forced through outer material layer 54. A retainer washer 264 receives blades 262 which are then bent outwardly into contact with washer 264 to retain the simulated nipple on the brassiere cup.

FIG. 27 illustrates a further embodiment of the invention wherein stud 266 is mounted upon a base element 268 having a plurality of depending rivet elements 270 which extend through outer fabric layer 54 and through corresponding apertures in a retainer plate 272. River elements 270 are deformed against the lower surface of retainer plate 272. As desired, retainer plate 272 may include through holes for receiving rivet elements 270 or appropriately located circumferential notches similar to those shown in FIG. 7D.

FIG. 28 illustrates a general purpose mounting base suitable for use with a variety of simulated nipples according to the invention. Base element 274 is situated on the outer surface of outer fabric layer 54 and includes a downwardly extending stem or rivet 276 which is inserted through outer material layer 54 and deformed over the bottom surface of a retaining washer 278, as indicated. Base element 274 is thus permanently affixed to the material of the brasssiere cup providing a support surface for the attachment of simulated nipples in the manners previously discussed. For example, the screw-on simulated nipple illustrated in FIG. 10A might easily be attached to base element 274.

FIG. 29 illustrates an embodiment of the invention in which a base element 280 of flexible material is suitably attached to outer material layer 54 and includes on a central portion thereof one-half of a hook and loop fastener similar to the commercially available VELCRO fasteners. The other half 284 of the similar to VELCRO fastener may be attached to an ornamental bauble 286 or nipple simulating stud as desired. In use, the ornamental bauble or nipple simulating stud may be easily removed from the brassiere by breaking the joint formed between the two-halves of the similar to VELCRO fastener.

Finally, FIG. 30 illustrate a simple embodiment of the invention wherein stud 288 is attached to a base 290 having a pin clasp 292 attached to the bottom surface thereof. In use, pin clasp 292 may be affixed to the apex of the breast receiving cups of a conventional brassiere to provide the simulated nipple affect in accordance with the teachings of this invention.

Having described my invention in sufficient detail to enable one skilled in the art to make and use it.

I claim:

1. An improved brassiere comprising a pair of breast receiving cups, said cups comprising an outer layer of flexible fabric material; and a simulated nipple attached to said outer layer of each cup, said nipple comprising a stud element having distal and proximal ends and an exterior profile simulating the profile of the nipple of a human female breast, said stud element being positioned interiorly of said cup with a portion of said outer layer deformed over said distal end, and means cooperating with said proximal end and said outer layer for attaching said stud element to said breast receiving cup, whereby the exterior profile of said stud element is noticeable exteriorly of said brassiere to enhance the appearance of bralessness when said brassiere is worn beneath outer garments.

2. The device according to claim 1, wherein said attaching means comprises an iron-on patch of material securing said stud element to the interior of said breast receiving cup, said layer being deformed into congruency with said stud element at the point of attachment.

3. The device according to claim 1, wherein said attaching means comprises a plate of suitable material bonded to the interior of said layer to retain said stud between said layer and said plate, said layer being deformed into congruency with said stud element at the point of attachment.

4. The device according to claim 1, wherein said attaching means comprises an anchor plate having deformable teeth on its periphery, said teeth piercing said layer from the interior thereof and gripping said stud element on the exterior of said layer.

5. The device according to claim 4, wherein said stud element has a radially extending flange adapted to be gripped by said deformable teeth.

6. The device according to claim 1, wherein said attaching means comprises an anchor ring having deformable teeth on its periphery, said teeth piercing said layer from the exterior thereof, said ring surrounding said stud element and securing it on the exterior of said layer.

7. The device according to claim 6, further comprising an anchor plate adapted to be gripped by said deformable teeth to secure said stud element to the material of said breast receiving cups.

8. The device according to claim 1, wherein said attaching means comprises a radially extending flange on said stud element, said flange being attached to said layer.

* * * * *